US009366511B1

(12) United States Patent
Wood

(10) Patent No.: US 9,366,511 B1
(45) Date of Patent: Jun. 14, 2016

(54) REDUCED DRAG PROJECTILE

(71) Applicant: Lockheed Martin Corporation, Bethesda, MD (US)

(72) Inventor: John A. Wood, Bethlehem, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 14/667,867

(22) Filed: Mar. 25, 2015

(51) Int. Cl.
*F42B 10/46* (2006.01)
*F42B 10/32* (2006.01)

(52) U.S. Cl.
CPC *F42B 10/46* (2013.01); *F42B 10/32* (2013.01)

(58) Field of Classification Search
CPC ..... F42B 10/46; F42B 10/00; F42B 10/32; F42B 10/38; F42B 30/02; F42B 5/02
USPC ..... 102/439
See application file for complete search history.

(56) References Cited

U.S. PATENT DOCUMENTS 2,963,864 A * 12/1960 Gross ..... F23R 3/18 431/158
3,838,645 A * 10/1974 Finger ..... F42C 19/04 102/211
6,681,700 B1 * 1/2004 Capewell ..... F42C 13/00 102/211
2013/0239791 A1 * 9/2013 Cho ..... F41A 21/00 89/14.7

OTHER PUBLICATIONS

Bivolaru, Daniel, et al., "Aerodynamic Modification of Supersonic Flow Around Truncated Cone Using a Pulsed Electrical Discharge," AIAA Journal, vol. 43, No. 7, Jul. 2005, 26 pages.
Gnemmi, Patrick, et al., "Guidance of a Supersonic Projectile by Plasma-Actuation Concept," Wind Tunnels and Experimental Fluid Dynamics Research, Chapter 31, Jul. 27, 2011, InTech, pp. 629-660.
Lago, V., et al., "Influence of the ionization rate of a plasma discharge applied to the modification of a supersonic low Reynolds number flow field around a cylinder," Journal of Physics D: Applied Physics, vol. 47, No. 12, Mar. 6, 2014, IOP Publishing Ltd, 13 pages.
Satyanand, Udyavar S., "An Experimental Investigation of Ionization of Supersonic Air by a Corona Discharge," Doctoral Dissertation, Department of Mechanical and Aerospace Engineering, The University of Texas at Arlington, Arlington, TX, Aug. 2005, 97 pages.

* cited by examiner

*Primary Examiner* — Joshua Freeman
(74) *Attorney, Agent, or Firm* — Withrow & Terranova, PLLC

(57) ABSTRACT

A reduced drag projectile is provided. The projectile includes a conductive shell that has a leading end and a trailing end. The conductive shell forms an interior volume. The projectile includes a conductive bullet core disposed at least partially within the interior volume. The conductive bullet core has a leading end element and is electrically insulated from the conductive shell. A voltage system is electrically coupled to the conductive shell and electrically coupled to the conductive bullet core. The projectile is configured to expose the leading end element to the atmosphere during flight, and the voltage system is configured to, during flight, generate a voltage at the leading end element that forms a corona discharge at the leading end element.

24 Claims, 9 Drawing Sheets

REDUCED DRAG PROJECTILE

TECHNICAL FIELD

The embodiments relate to projectiles and, in particular, to a reduced drag projectile.

BACKGROUND

"Drag" refers to forces acting opposite to the relative motion of an object moving with respect to a surrounding fluid. In the case of a projectile traveling through the atmosphere, drag is sometimes referred to as air resistance. The range of a projectile discharged into the atmosphere depends in substantial part on drag. The range of a projectile can be increased if drag can be reduced. Moreover, less force is required to launch a projectile a given distance if drag is reduced.

Reducing the drag associated with a projectile provides many advantages. If all other factors remain constant, reducing the drag reduces the amount of accelerant, such as gunpowder, required to propel the projectile a given distance, allowing for a reduction in the size of the cartridge in which the projectile is packaged. Smaller cartridges in turn allow a greater number of cartridges to be carried in the same amount of space, and thus soldiers and law enforcement personnel can carry a greater number of cartridges into an adverse situation than would otherwise be possible. Alternatively, reducing drag while maintaining the same amount of propellant material will increase the range of the projectile. Increasing the range of a projectile may allow the use of a smaller weapon than would otherwise be required to propel the projectile a desired distance. Where the weapon is used by a soldier, increasing the range may allow the threat to be kept at such a distance that lighter body armor may be used.

A corona discharge is a partial breakdown of a dielectric surrounding a point on a high voltage conductor that has a high electrical stress. Studies utilizing supersonic wind tunnels have shown that a corona discharge formed on the leading edge of an object moving with respect to air can reduce the drag of the object.

SUMMARY

The embodiments relate to a reduced drag projectile, wherein a corona discharge is formed at a leading end element of the projectile during flight. The corona discharge reduces drag associated with the projectile and thereby increases range, which allows the projectile to travel a greater distance than would otherwise occur. Moreover, the use of a reduced drag projectile may allow a smaller weapon to be used to discharge the projectile than would otherwise be necessary.

In one embodiment, a projectile is provided. The projectile includes a conductive shell that has a leading end and a trailing end. The conductive shell forms an interior volume. The projectile includes a conductive bullet core disposed at least partially within the interior volume. The conductive bullet core has a leading end element and is electrically insulated from the conductive shell. A voltage system is electrically coupled to the conductive shell and electrically coupled to the conductive bullet core. The projectile is configured to expose the leading end element to the atmosphere during flight, and the voltage system is configured to, during flight, generate a voltage at the leading end element that forms a corona discharge at the leading end element.

In one embodiment, the leading end of the conductive shell forms an opening sized to allow at least a portion of the leading end element to extend beyond the opening.

In one embodiment, the projectile has a pre-discharge orientation and a post-discharge orientation that is different from the pre-discharge orientation. The projectile includes a non-conductive cap coupled to the leading end of the conductive shell. The non-conductive cap is configured to prevent the leading end element from extending beyond the non-conductive cap in the pre-discharge orientation.

In one embodiment, the voltage system includes a piezoelectric element and a resistor coupled between the piezoelectric element and the conductive bullet core.

In one embodiment, the projectile includes an insulator positioned between the piezoelectric element and the conductive bullet core. The insulator may include an annular opening in which the resistor is disposed. In one embodiment, the insulator comprises sapphire.

In one embodiment, the trailing end of the conductive shell forms an opening between the interior volume and an environment exterior to the trailing end of the conductive shell. The opening is configured to allow pressure generated in the environment to enter the interior volume. In one embodiment, the opening is a predetermined size to allow a predetermined pressure generated in the environment to enter the interior volume.

In one embodiment, the projectile includes a crush piston positioned within the interior volume between the opening and the piezoelectric element. The crush piston is configured to move the piezoelectric element with respect to the conductive shell in a direction toward the leading end of the conductive shell.

In one embodiment, the projectile includes an insulative collar that completely surrounds at least a portion of an outer perimeter of the piezoelectric element and inhibits direct electrical contact between the piezoelectric element and the conductive shell.

In one embodiment, the projectile has a pre-discharge orientation and a post-discharge orientation that is different from the pre-discharge orientation. The conductive shell has an interior surface configured to halt forward progress of the conductive bullet core with respect to the conductive shell as the conductive bullet core is moved from the pre-discharge orientation to the post-discharge orientation.

In one embodiment, the projectile includes a bearing travel stop configured to engage the interior surface of the conductive shell and to engage the conductive bullet core to halt the forward progress of the conductive bullet core with respect to the conductive shell as the conductive bullet core is moved from the pre-discharge orientation to the post-discharge orientation.

In one embodiment, the conductive shell comprises an interior surface and a polymide film coating disposed on the interior surface. The conductive bullet core comprises an exterior surface and a polymide film coating disposed on the exterior surface. The projectile has a pre-discharge orientation and a post-discharge orientation that is different from the pre-discharge orientation. In the post-discharge orientation, the polymide film coating disposed on the exterior surface of the conductive bullet core is bonded with the polymide film coating disposed on the interior surface of the conductive shell such that the conductive bullet core is fixed with respect to the conductive shell.

In one embodiment, the voltage system comprises a piezoelectric element and a diode comprising a first diode terminal and a second diode terminal. The first diode terminal is electrically coupled to the piezoelectric element. The voltage system also includes a capacitor that has a first capacitor terminal and a second capacitor terminal. The first capacitor terminal is electrically coupled to the second diode terminal. The voltage system further includes a resistor that includes a first resistor terminal and a second resistor terminal. The first resistor terminal is coupled to the second diode terminal, and the second resistor terminal is coupled to the conductive bullet core.

Those skilled in the art will appreciate the scope of the disclosure and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The use herein of ordinals in conjunction with an element is solely for distinguishing what might otherwise be similar or identical labels, such as "first terminal" and "second terminal," and does not imply a priority, a type, an importance, or other attribute, unless otherwise stated herein. The term "about" used herein in conjunction with a numeric value means any value that is within a range of ten percent greater than or ten percent less than the numeric value.

The embodiments relate to a reduced drag projectile, wherein a corona discharge is formed at a leading end element of the projectile during flight. The corona discharge reduces drag associated with the projectile and thereby increases range, which allows the projectile to travel a greater distance than would otherwise occur. Moreover, the use of a reduced drag projectile may allow a smaller weapon to be used to fire the projectile than would otherwise be necessary.

Figure 1:
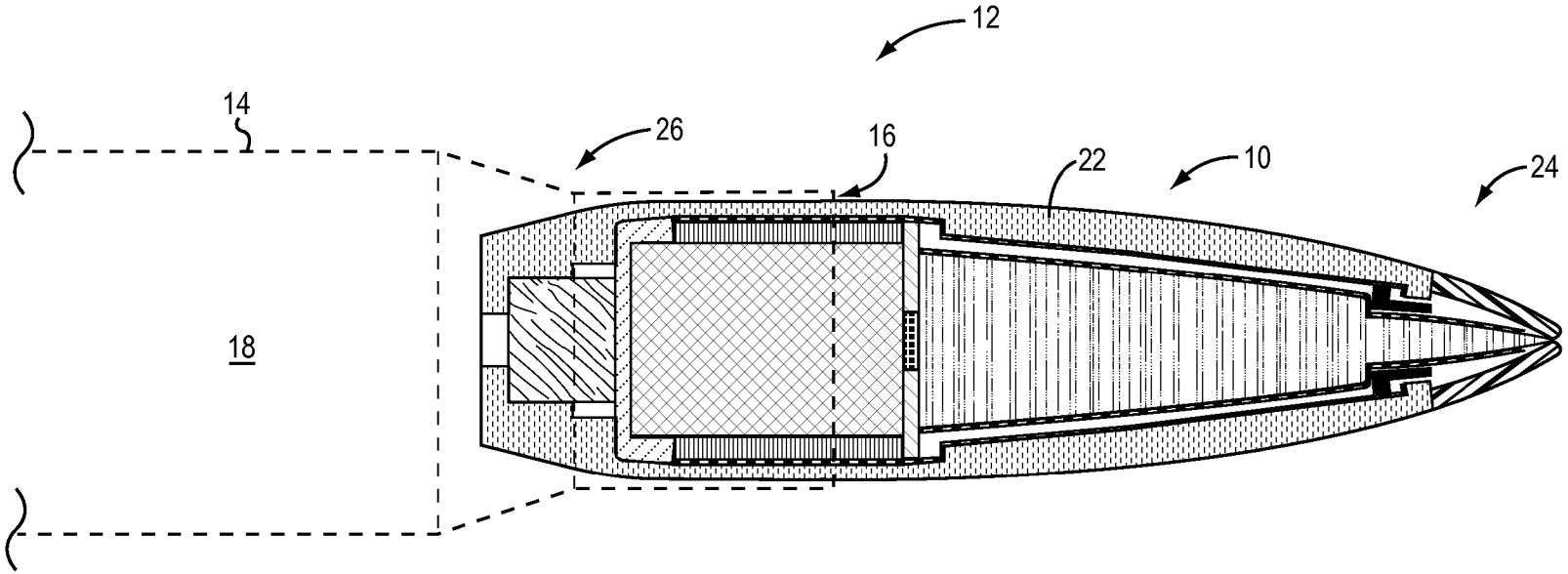
FIG. 1 is a cross-sectional diagram of a reduced drag projectile according to one embodiment.

FIG. 1 is a cross-sectional diagram of a reduced drag projectile 10 according to one embodiment. The projectile 10 has a pre-discharge orientation 12, illustrated in FIGS. 1 and 2, and a post-discharge orientation illustrated in FIG. 3. In some embodiments, in the pre-discharge orientation 12, the projectile 10 may be coupled to a case 14. The case 14 forms an opening 16 in an interior volume 18. The interior volume 18 may contain a propellant, such as gun powder, for example (not illustrated). The projectile 10 includes a conductive shell 22 that has a leading end 24 and a trailing end 26. The trailing end 26 is positioned within the opening 16 and extends at least partially into the interior volume 18. The case 14 is configured to grip an exterior surface of the trailing end 26 of the projectile 10 to maintain the projectile 10 in the case 14 prior to being discharged.

Figure 2:
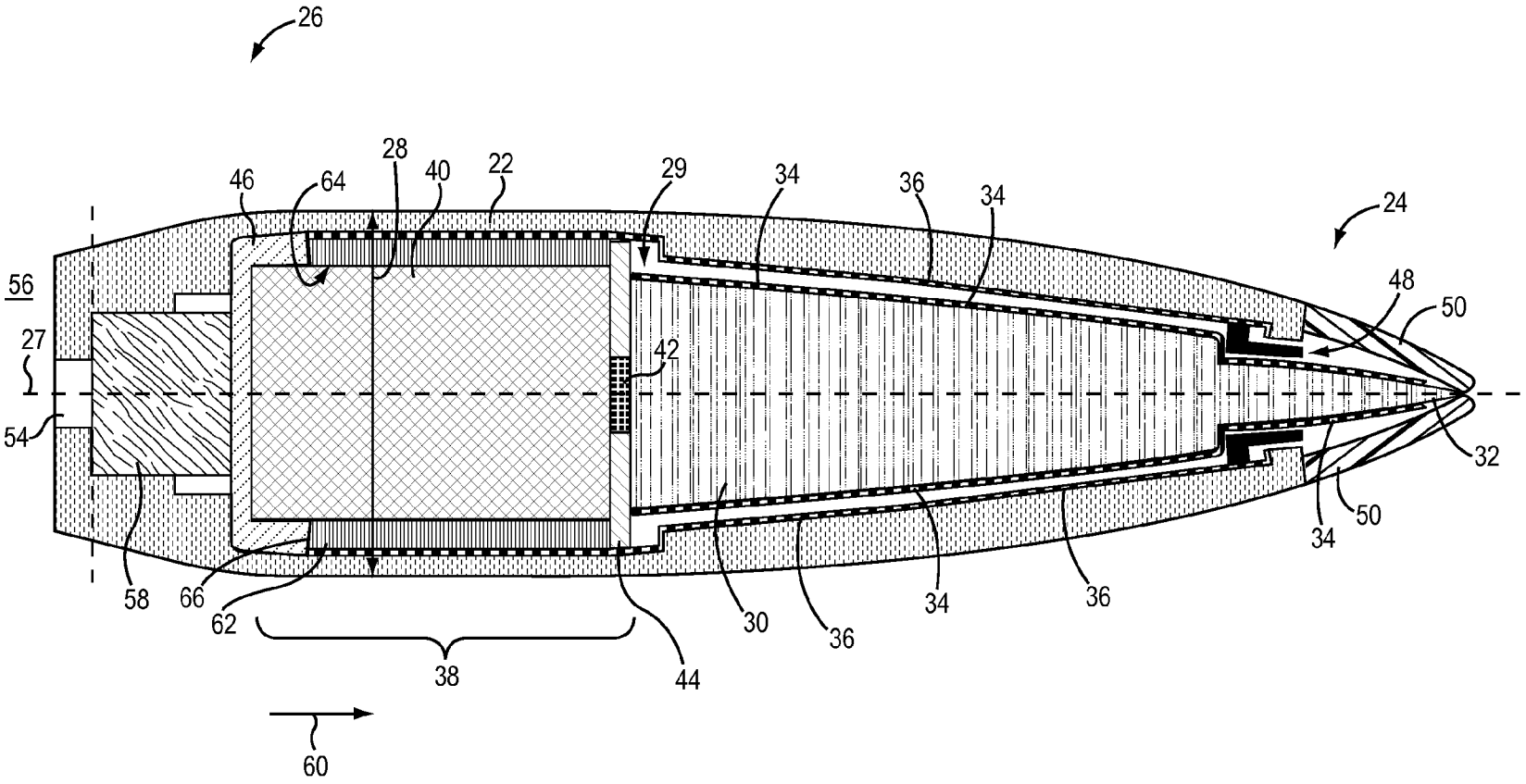
FIG. 2 is an enlarged cross-sectional diagram of the projectile illustrated in FIG. 1.

FIG. 2 is an enlarged cross-sectional diagram of the projectile 10 illustrated in FIG. 1, with the case 14 omitted for purposes of illustration. The conductive shell 22 comprises a conductive material such as, by way of non-limiting example, copper, brass, copper-clad steel, bronze, or any other suitable conductive material.

The projectile 10 is generally symmetrical about a longitudinal axis 27 and has a greatest diameter 28 perpendicular to the longitudinal axis 27 at some location along the projectile 10. The greatest diameter 28 may be based on a desired weapon from which the projectile 10 will be discharged. In some embodiments, the projectile 10 is sized to fit a particular caliber barrel, such as a .308 caliber barrel or a 7.62 millimeter (mm) caliber barrel. However, the greatest diameter 28 of the projectile 10 is not limited to sub-1-inch diameters and may comprise a larger diameter for other larger projectiles.

The conductive shell 22 forms an interior volume 29. A conductive bullet core 30 is disposed at least partially within the interior volume 29 and has a leading end element 32. The conductive bullet core 30 is electrically insulated from the conductive shell 22. In particular, in one embodiment, an electric insulator 34 surrounds an exterior perimeter of the conductive bullet core 30. In one embodiment, the electric insulator 34 may be adhered to the exterior surface of the conductive bullet core 30 prior to assembly of the projectile 10. Similarly, an interior surface of the conductive shell 22 may be covered by an electric insulator 36. Again, the electric insulator 36 may be adhered to the interior surface of the conductive shell 22 prior to assembly of the projectile 10. The electric insulator 34 and the electric insulator 36 may comprise any insulative polymer or material that will bond to the respective conductive surfaces, and to one another when in the post-discharge orientation. The electric insulator 34 and the electric insulator 36 may provide sufficient insulative value to prevent arcing between the conductive bullet core 30 and the conductive shell 22. The thickness of the electric insulator 34 and the electric insulator 36 may in part be based on the voltage carried by the conductive bullet core 30. In one embodiment, the electric insulator 34 and the electric insulator 36 comprise a polymide film, such as, by way of non-limiting example, a Kapton® polymide film.

A voltage system 38 is electrically coupled to the conductive shell 22 and electrically coupled to the conductive bullet core 30. The projectile 10 is configured to expose a leading end element 32 to the atmosphere during flight. The voltage system 38 is configured to, during flight, generate a voltage at the leading end element 32 that forms a corona discharge at the leading end element 32. In some embodiments, the corona discharge may be formed for several seconds. In other embodiments, where the conductive shell 22 has a relatively large diameter, such as in the case of the projectile 10 being used in a cannon, the corona discharge may last substantially longer, such as more than a minute. While the corona discharge is formed, the drag associated with the projectile 10 traveling through the atmosphere is reduced, increasing the range of the projectile 10.

The conductive bullet core 30 may comprise any desired material, such as, by way of non-limiting example, tungsten, molybdenum, niobium, tantalum, rhenium, depleted uranium, or steel.

In one embodiment, the voltage system 38 includes a piezoelectric element 40 and a current-limiting resistor 42. The current-limiting resistor 42 limits the electrical current powering the corona discharge such that the corona discharge is sufficient to reduce drag for a relatively extended period of time. In one embodiment, the piezoelectric element 40 is about 6 mm in diameter, is about 15 mm in length, has a density of about 7.7, and weighs about 50 grains. However, it is apparent that the piezoelectric element 40 may be sized depending on the particular application. The resistor 42 is configured to provide sufficient current for a corona discharge to form at the leading end element 32 for a desired period of time, such as, by way of non-limiting example, 2-3 seconds. In one embodiment, the resistor 42 is disposed in an insulator 44 that electrically insulates the conductive bullet core 30 from the piezoelectric element 40. In one embodiment, the piezoelectric element 40 is electrically coupled to the conductive shell 22 via an annular metal guide 46.

The conductive shell 22 forms an opening 48 that is sized to allow at least a portion of the leading end element 32 to extend beyond the opening 48. The projectile 10 also includes a non-conductive cap 50 that is coupled to the leading end 24 of the conductive shell 22. The non-conductive cap 50 is configured to prevent the leading end element 32 from extending beyond the non-conductive cap 50 in the pre-discharge orientation 12. The non-conductive cap 50 creates a distance between the leading end element 32 and the conductive shell 22 during flight of the projectile 10 and also protects accidental contact between an object, such as a body part, and the leading end element 32. In some embodiments, the leading end element 32 is relatively sharp and has a radius less than about 30 to about 50 microns. In other embodiments, the leading end element 32 may have a radius greater than about 30 to about 50 microns; however, a leading end element 32 having a larger radius will utilize a higher voltage, which may decrease the duration of the corona discharge.

The trailing end 26 of the conductive shell 22 forms an opening 54 between the interior volume 29 and an environment 56 that is exterior to the trailing end 26 of the conductive shell 22. The opening 54 is configured to allow pressure generated in the environment 56 to enter the interior volume 29. The environment 56 may initially comprise, for example, the interior volume 18 of the case 14 during the discharge process. After the projectile 10 is discharged from the case 14, the environment 56 may include an interior volume inside a barrel, such as a rifle barrel. In some embodiments, the opening 54 is a predetermined size that allows the predetermined pressure generated in the environment 56 to enter the interior volume 29 via the opening 54.

The projectile 10 includes a crush piston 58 positioned within the interior volume 29 between the opening 54 and the piezoelectric element 40. The crush piston 58 is configured to, in response to pressure entering the opening 54, move the piezoelectric element 40 with respect to the conductive shell 22 in a direction 60 toward the leading end 24 of the conductive shell 22. The projectile 10 also includes an insulative collar 62 that surrounds at least a portion of an outer perimeter 64 of the piezoelectric element 40. The insulative collar 62 prevents or otherwise inhibits direct electrical contact between the piezoelectric element 40 and the conductive shell 22 along such portion of the outer perimeter 64. In one embodiment, the annular metal guide 46 is positioned between the piezoelectric element 40 and the crush piston 58. The annular metal guide 46 is in electrical contact with the piezoelectric element 40 and the conductive shell 22.

In one embodiment, the annular metal guide 46 includes an annular edge 66 that is in contact with the insulative collar 62. The annular edge 66 is configured to urge the insulative collar 62 in the direction 60 toward the leading end 24 of the conductive shell 22.

Figure 3:
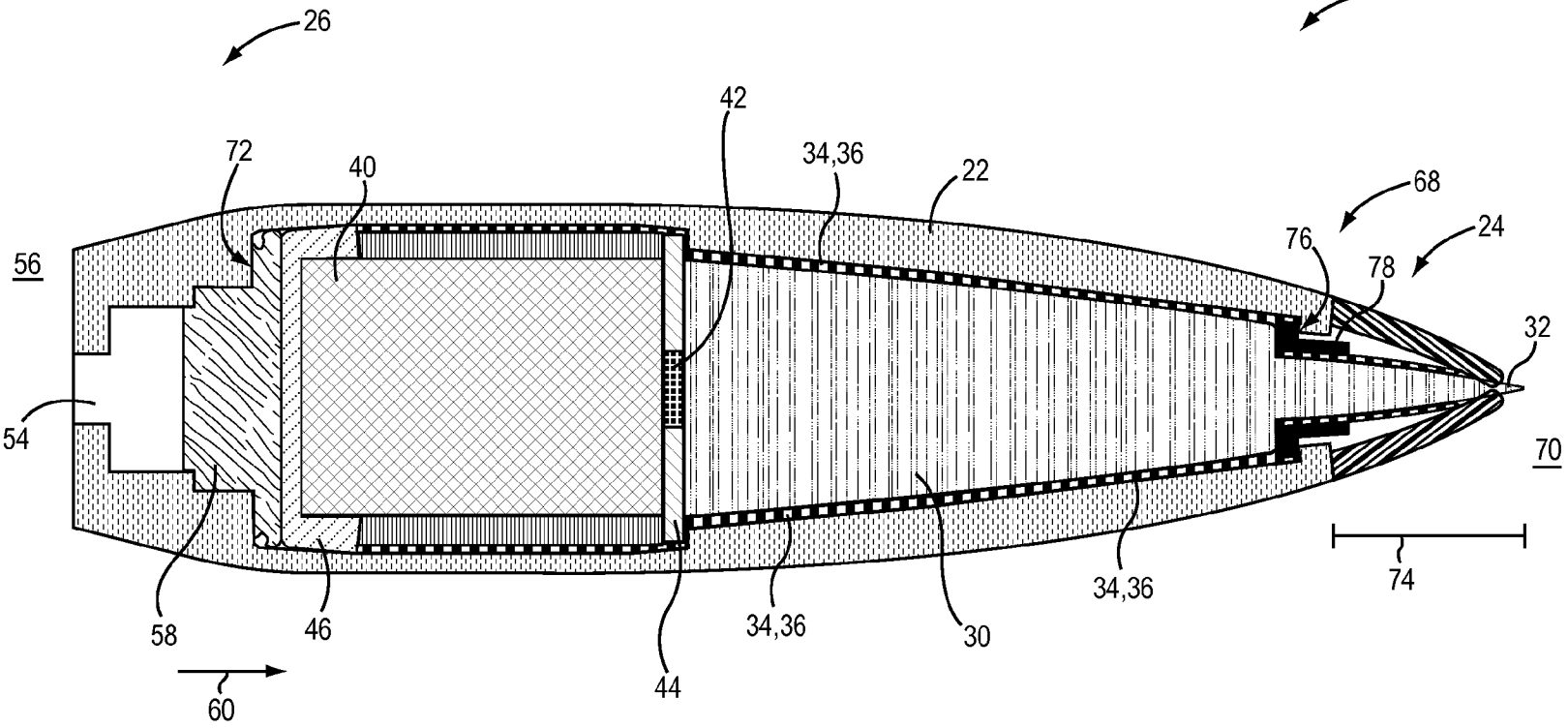
FIG. 3 is a cross-sectional diagram of the projectile illustrated in FIGS. 1 and 2 shown in a post-discharge orientation according to one embodiment.

FIG. 3 is a cross-sectional diagram of the projectile 10 illustrated in FIGS. 1 and 2 shown in a post-discharge orientation 68, according to one embodiment. As pressure from the environment 56 builds up in the opening 54, the crush piston 58 is urged forward in the direction 60. The exterior surface of the conductive shell 22 experiences frictional forces with the barrel of the weapon in which the projectile 10 is being discharged. Consequently, the crush piston 58 moves the annular metal guide 46 with respect to the conductive shell 22 in the direction 60, which in turn moves the piezoelectric element 40, the insulator 44, and the conductive bullet core 30 forward with respect to the conductive shell 22. The leading end element 32 moves past the end of the non-conductive cap 50 and is exposed to an atmosphere 70 upon exiting the barrel of the weapon. The crush piston 58 is preferably made of a metal, such as copper or the like, which deforms under sufficient pressure. The crush piston 58 causes the annular metal guide 46 to move with respect to the conductive shell 22. The crush piston 58 at least partially fills the void formed between the annular metal guide 46 and an interior surface 72 of the conductive shell 22 and maintains pressure against the annular metal guide 46. This pressure in turn compresses the piezoelectric element 40, generating a voltage.

One terminal of the piezoelectric element 40 is electrically coupled to the conductive bullet core 30 via the resistor 42, and another terminal of the piezoelectric element 40 is coupled to the conductive shell 22 via the annular metal guide 46, creating a voltage between the leading end element 32 and the conductive shell 22. Due to the distance 74 between the leading end element 32 and the conductive shell 22 and the relatively small radius of the leading end element 32, an electrical overstress condition occurs at the leading end element 32, and a corona discharge is formed during flight of the projectile 10.

In one embodiment, the conductive shell 22 includes an interior surface 76 that is configured to halt forward progress of the conductive bullet core 30 with respect to the conductive shell 22 as the conductive bullet core 30 is moving from the pre-discharge orientation 12 to the post-discharge orientation 68. In one embodiment, the projectile 10 includes a bearing travel stop 78 that is configured to engage the interior surface 76 of the conductive shell 22 and to engage the conductive bullet core 30 to halt the forward progress of the conductive bullet core 30 with respect to the conductive shell 22 as the conductive bullet core 30 is moving from the pre-discharge orientation 12 to the post-discharge orientation 68. In one embodiment, the bearing travel stop 78 comprises sapphire.

In one embodiment, in the post-discharge orientation 68, the electric insulators 34, 36 bond due to the temperatures and pressures generated as the conductive bullet core 30 is urged forward with respect to the conductive shell 22, such that the conductive bullet core 30 becomes fixed with respect to the conductive shell 22. Fixing the conductive bullet core 30 with respect to the conductive shell 22 enables the conductive bullet core 30 to rotate with the rotation of the conductive shell 22 as rifling in the barrel through which the projectile 10 is discharged imparts rotational forces upon the projectile 10.

Figure 4:
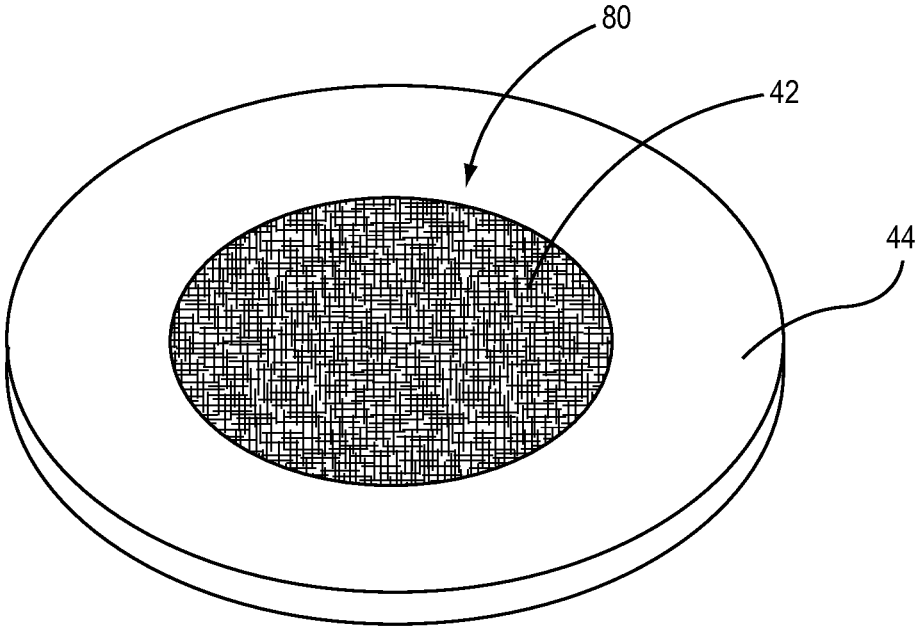
FIG. 4 is a block diagram of an insulator and a resistor according to one embodiment.

FIG. 4 is a block diagram of the insulator 44 and resistor 42 according to one embodiment. As discussed above, the insulator 44 inhibits electrical contact between the conductive bullet core 30 and the piezoelectric element 40, ensuring any electric current flow between the conductive bullet core 30 and the piezoelectric element 40 occurs via the resistor 42. In this embodiment, the insulator 44 is annular and forms an opening 80 at a center of the insulator 44. The resistor 42 is disposed in the opening 80 and allows the electric current to flow from the piezoelectric element 40 to the conductive bullet core 30 when the piezoelectric element 40 is stressed or otherwise deformed. As discussed above, the insulator 44 may comprise any suitable insulative material, including, by way of non-limiting example, sapphire, fused aluminum oxide, ceramic, or porcelain.

Figure 5:
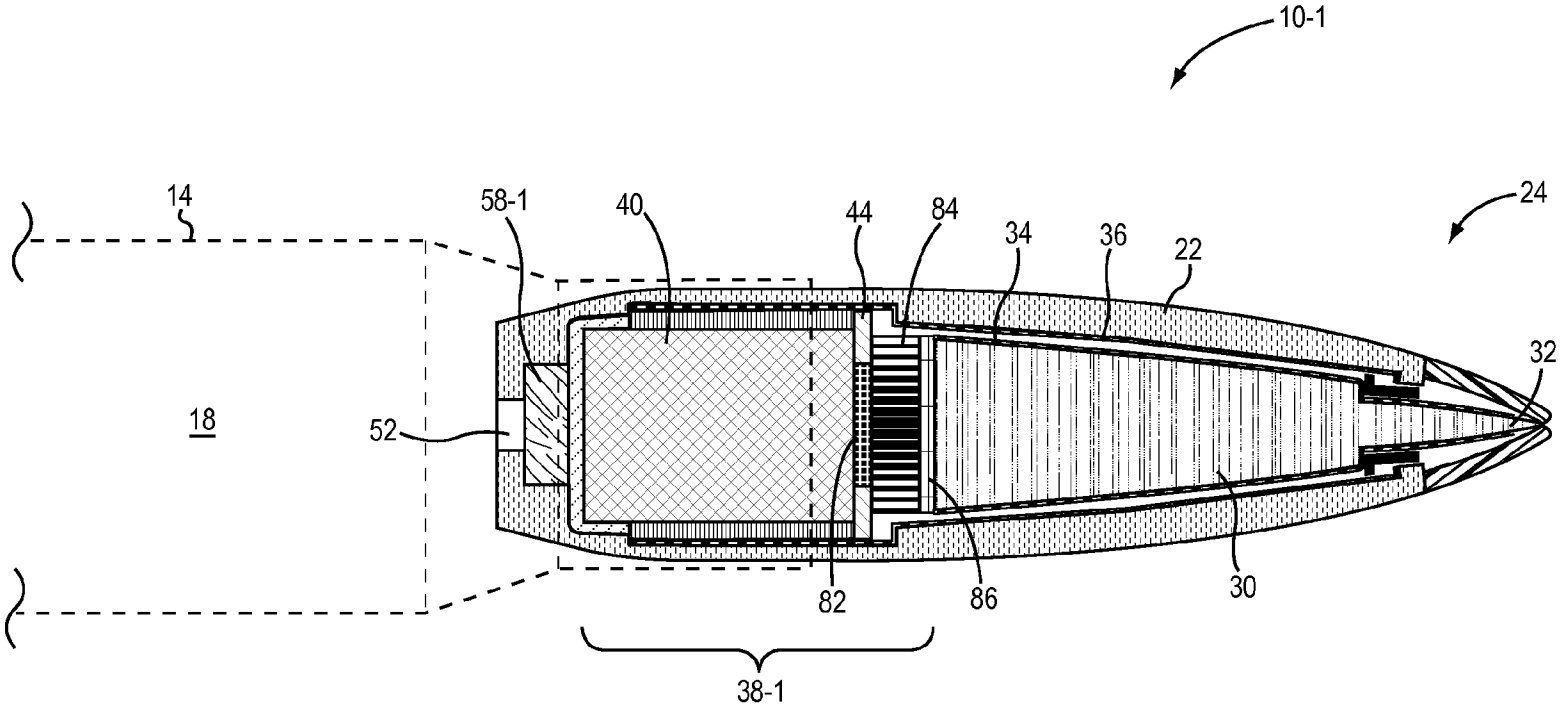
FIG. 5 is a cross-sectional diagram of the projectile shown in a pre-discharge orientation according to another embodiment.

FIG. 5 is a cross-sectional diagram of a projectile 10-1 according to another embodiment. The projectile 10-1 is substantially similar or identical to the projectile 10 discussed above with regard to FIGS. 1-4, unless otherwise specifically stated herein. In this embodiment, the projectile 10-1 includes a diode 82 comprising a first diode terminal and a second diode terminal and positioned within the insulator 44. The first diode terminal is electrically coupled to the piezoelectric element 40. The second diode terminal is electrically coupled to a capacitor 84. The capacitor 84 comprises a supercapacitor or an ultracapacitor. The capacitor 84 has a first capacitor terminal that is electrically coupled to the second diode terminal and a second capacitor terminal that is coupled to a resistor 86. The resistor 86 has a first resistor terminal that is coupled to the second diode terminal and a second resistor terminal that is coupled to the conductive bullet core 30.

Figure 6:
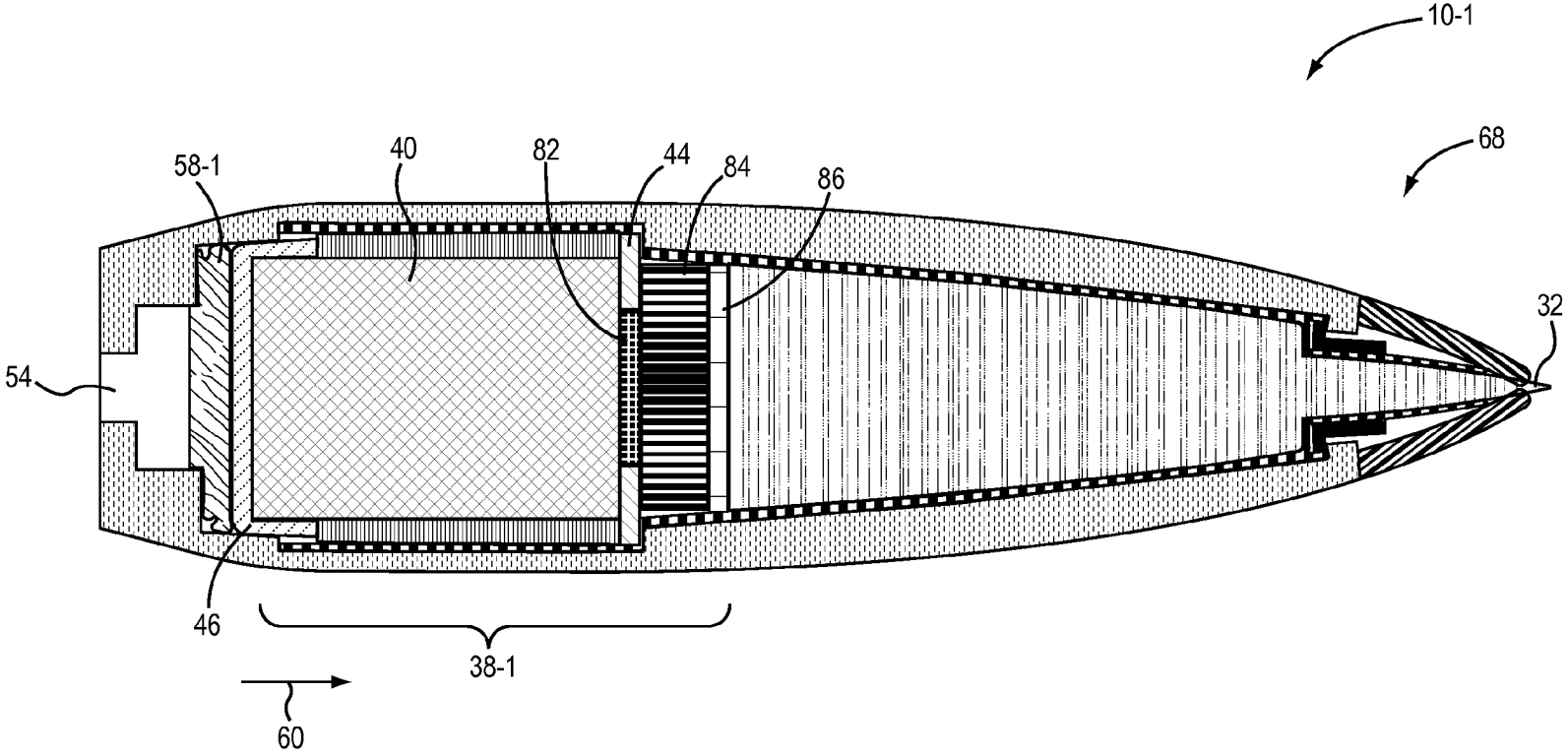
FIG. 6 is a cross-sectional diagram of the projectile illustrated in FIG. 5 shown in a post-discharge orientation according to one embodiment.

FIG. 6 is a cross-sectional diagram of the projectile 10-1 in the post-discharge orientation 68. In this embodiment, a crush piston 58-1 urges the annular metal guide 46 forward with respect to the conductive shell 22 in the direction 60. The piezoelectric element 40 is jolted by the crush piston 58-1 and generates a current, which flows through the diode 82 into the supercapacitor 84. The supercapacitor 84 releases voltage via the resistor 86 to the conductive bullet core 30 to form a corona discharge at the leading end element 32.

In one embodiment, the electrical connections between the elements that make up the voltage systems 38, 38-1 may be maintained by the pressure exerted by the crush pistons 58, 58-1, respectively. In another embodiment, a ribbon of copper or other conductive material may be soldered or welded between each such element to prevent any bounce or jarring from disconnecting the electrical connections momentarily.

Example Embodiment

As an example for sizing the piezoelectric element 40 to generate a corona discharge at the leading end element 32 during flight of the projectile 10, 10-1, assume the following:

1) The projectile 10, 10-1 will be sized to fit in a 7.62 mm barrel.

2) A maximum reasonable size for a cylindrical piezoelectric element 40 contained within a 7.62 mm diameter projectile is 6.0 mm in diameter and 15 mm in length.

In this example, 0.424 joules of energy are available, in accordance with the following formula.

V (voltage)=π times (×) radius(r)$^2$×height (h)=π×(0.60)$^2$×1.50=0.424 cm$^2$=0.424 joules. A leading end element 32 having a sufficiently sharp tip, such as having a radius less than or equal to 35 microns, can maintain a negative discharge in air at an atmospheric pressure of about 4,500 volts. It will be assumed, from a conservative approach, that 9,500 volts are needed to produce a corona discharge at Mach 2.5 from such a leading end element 32. It will further be assumed that 15 microamperes are sufficient to maintain the corona discharge for the projectile 10, 10-1. Note that 1 Watt=1 Joule/second. P (power)=9.5×10$^3$ volts×1.5×10$^{-5}$ amps=0.143 watts=0.143 joules/second. Therefore, in this example, 0.143 Joules/second are needed to maintain a corona discharge at the leading end element 32. Because 0.424 joules of energy are available, the corona discharge would be formed at the leading end element 32 for a maximum of about 2.97 seconds, in this example.

Figure 7:
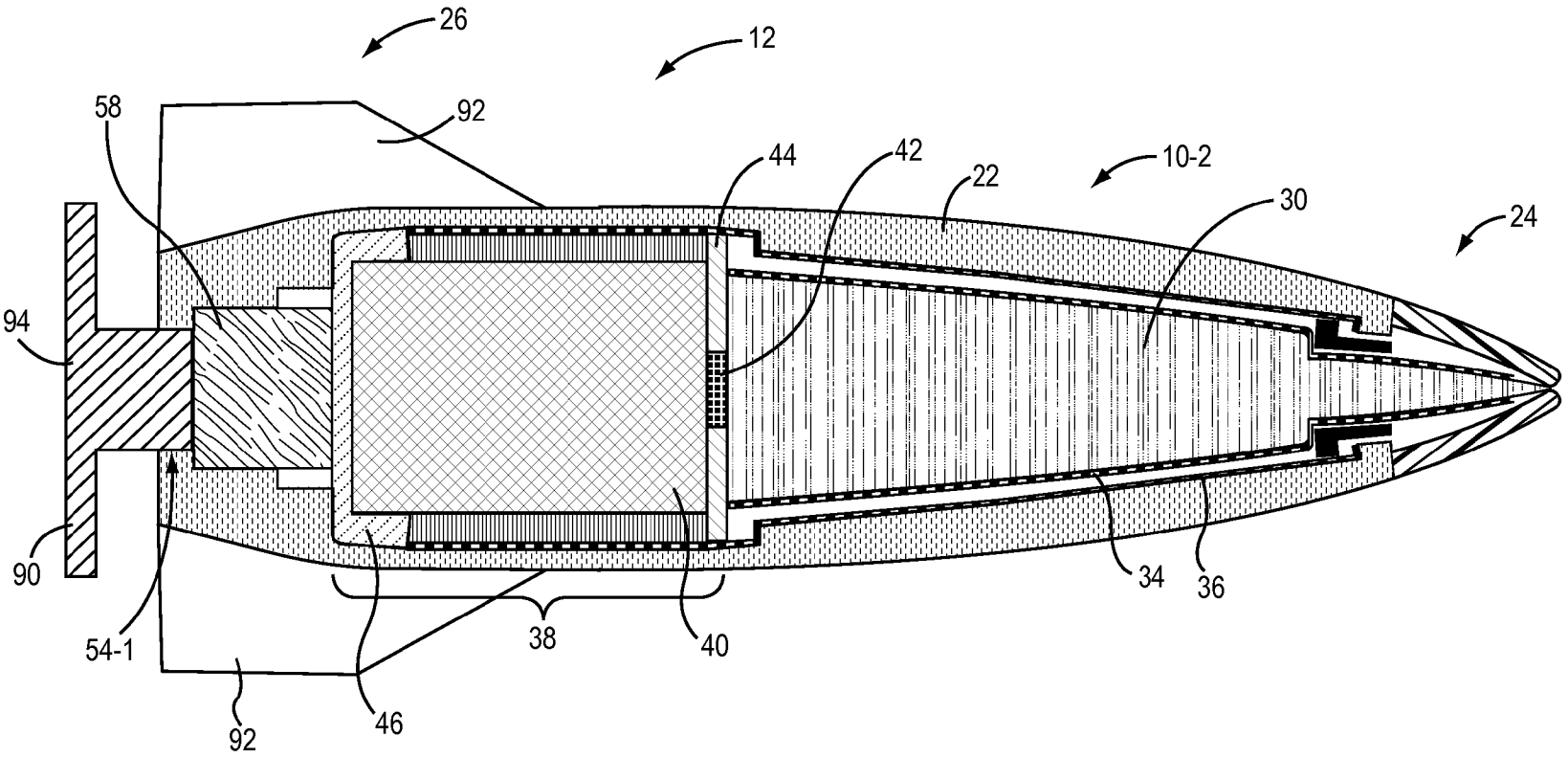
FIG. 7 is a cross-sectional diagram of a projectile according to another embodiment.

FIG. 7 is a cross-sectional diagram of the projectile 10-2 according to another embodiment. The projectile 10-2 is substantially similar to the projectiles 10, 10-1 except as otherwise stated herein. In this embodiment, the projectile 10-2 may be discharged via a trolley, or armature, such as may be used in a field cannon, a tank cannon, or an electromagnetic rail gun, for example. The projectile 10-2 has an opening 54-1 that is sized to allow the entry of a launch plug 90 to enter the conductive shell 22 and contact the crush piston 58. The projectile 10-2 may also include one or more fins 92 for purposes of aerodynamic stabilization. The projectile 10-2 may be utilized, by way of non-limiting example, with a tank cannon or electromagnetic rail gun. During discharge of the projectile 10-2, a surface 94 of the launch plug 90 is positioned against the particular launching mechanism. As the launching mechanism urges the launch plug 90 in the direction of flight, the launch plug 90 urges the crush piston 58 against the annular metal guide 46, which in turn compresses or otherwise deforms the piezoelectric element 40 to generate electricity. In some embodiments, the projectile 10-2 may be contained within a sabot when discharged.

Figure 8:
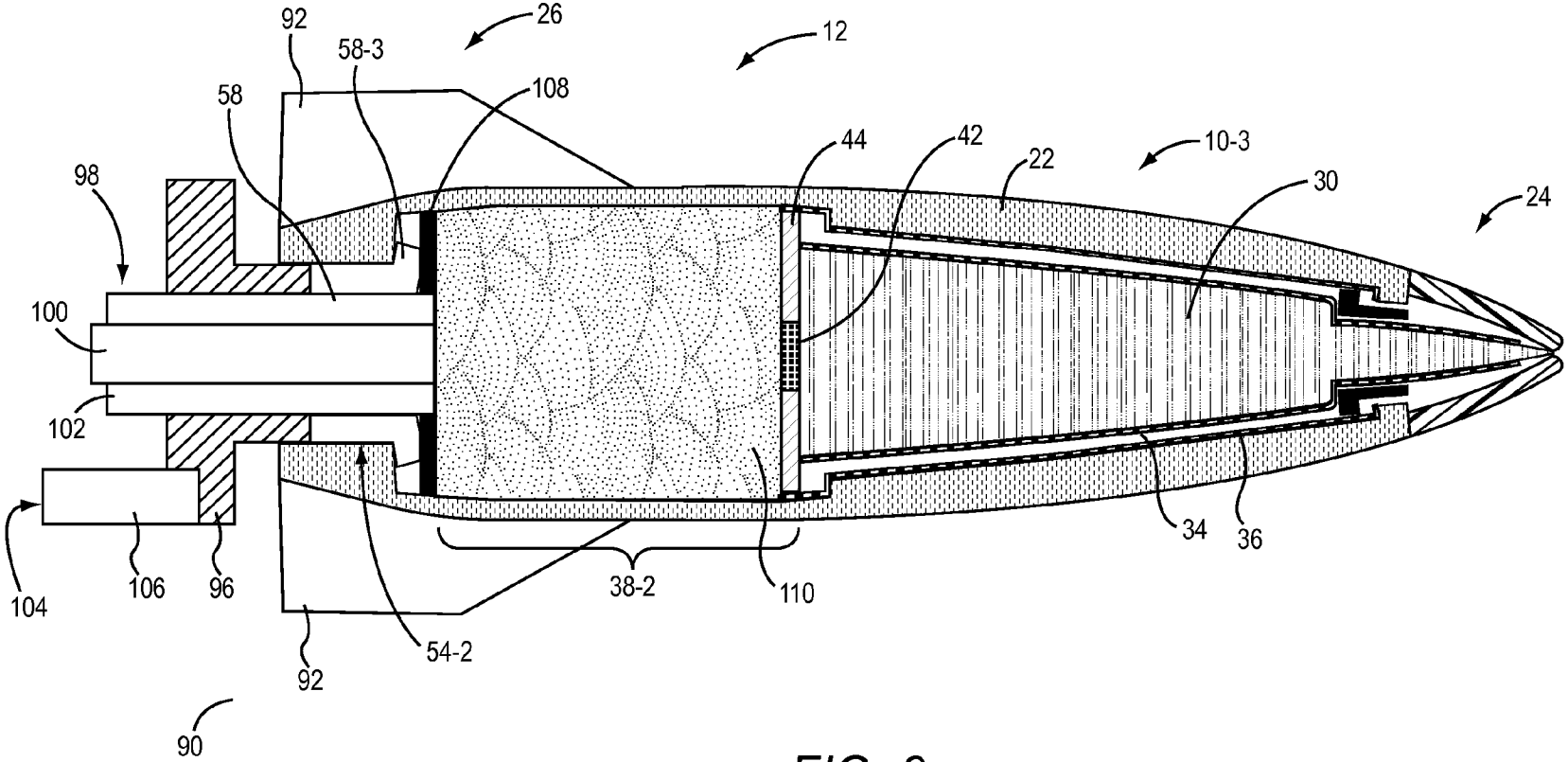
FIG. 8 is a cross-sectional diagram of a projectile according to another embodiment.

FIG. 8 is a cross-sectional diagram of a projectile 10-3 according to another embodiment. In this embodiment, the projectile 10-3 is launched via an electromagnetic rail gun (not illustrated). The projectile 10-3 is substantially similar to the projectiles 10, 10-1, 10-2 except as otherwise stated herein. Again, the projectile 10-3 may be enclosed in a sabot (not illustrated) when discharged. The projectile 10-3 may include the fins 92 for aerodynamic stabilization. The projectile 10-3 includes an opening 54-2 sized to receive a hollow plug 96 that is electrically conductive and is in electrical contact with the conductive shell 22. In this embodiment, the hollow plug 96 is coupled directly or indirectly to an armature (not illustrated) of the rail gun that moves rapidly down the rails upon discharge. A coil (not illustrated) is passed through the electromagnetic field that exists between the rails during operation. The coil includes a first coil end 98, which extends through an opening in the hollow plug 96 and makes electrical contact with a capacitor 110 to charge the capacitor 110 during discharge. The first coil end 98 includes a conductor 100 and an insulator 102 to prevent the conductor 100 from coming into electrical contact with the hollow plug 96.

A second coil end 104 includes a conductor 106 that is in electrical contact with the hollow plug 96. During discharge, a crush piston 58-3 contacts a support structure 108, which contacts the capacitor 110. As the coil moves through the electromagnetic field generated during operation of the electromagnetic rail gun, a current is produced that travels via the first coil end 98 into the capacitor 110 to charge the capacitor 110.

The capacitor 110 may comprise any suitable type of capacitor or capacitors. If the capacitor 110 is a concentric capacitor, the capacitor 110 need not be insulated from the conductive shell 22. If the capacitor 110 is a stacked capacitor design, the capacitor 110 should be insulated from the conductive shell 22.

Figure 9:
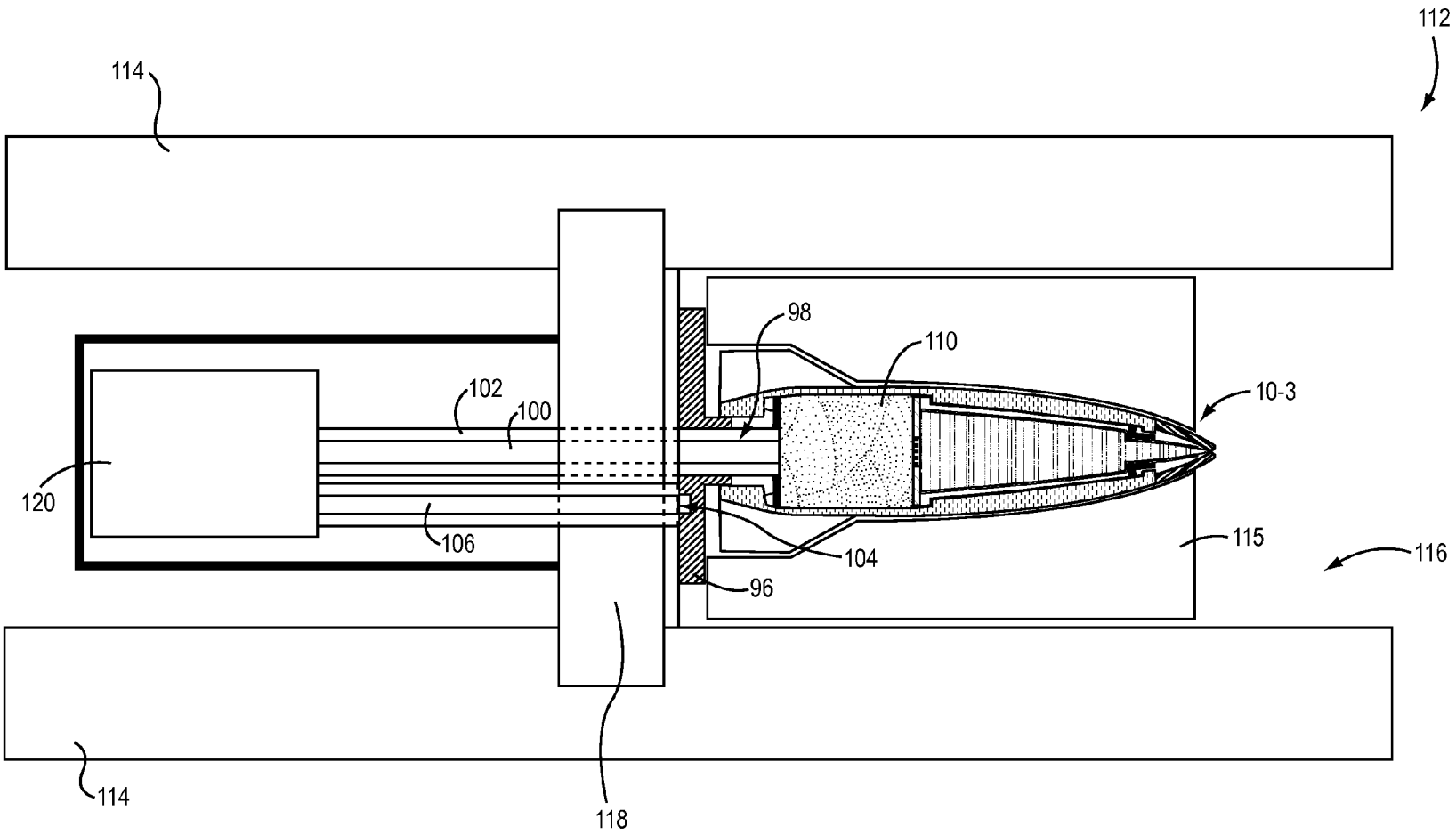
FIG. 9 is a diagram of an electromagnetic rail gun from which the projectiles illustrated in FIGS. 7 and 8 may be discharged, according to one embodiment.

FIG. 9 is diagram of a rail gun 112 according to one embodiment. The rail gun 112 comprises a plurality of rails 114. While only two rails 114 are illustrated, the rail gun 112 may comprise any desired number of rails 114. Prior to discharge, the projectile 10-3 is enclosed within a sabot 115 and positioned in a volume 116 between the rails 114 and coupled to an armature 118 via the hollow plug 96. The first coil end 98 is connected to the capacitor 110, and the second coil end 104 is connected to the hollow plug 96. The first coil end 98 and the second coil end 104 are electrically coupled to a coil 120 that moves through the electromagnetic field created in the volume 116 during discharge of the projectile 10-3. During discharge, the projectile 10-3 ultimately separates from the first coil end 98 and the second coil end 104.

Among other advantages, the embodiments increase the effective range of the projectiles 10, 10-1, 10-2, 10-3 by reducing aerodynamic drag during the flight of the projectiles 10, 10-1, 10-2, 10-3. Increased effective range in this manner does not require increasing muzzle velocity or utilizing a larger caliber weapon. Increasing muzzle velocity via other mechanisms, such as by increasing an amount of propellant, decreases barrel life and increases recoil, as well as the size of the case, thereby limiting the amount of ammunition that can be transported.

It should be noted that the number of Joules of electrical energy available for the corona discharge is in part dependent on the volume of the piezoelectric element 40 or capacitors 84, 110. Depending on projectile configuration, the volume of the energy storage medium will increase based on the square of the increase in diameter of the projectiles 10, 10-1, 10-2, 10-3. Therefore, the time duration of the corona discharge will increase substantially for larger projectiles 10, 10-1, 10-2, 10-3. Even allowing for the increased current needed to provide the drag reduction for larger projectiles 10, 10-1, 10-2, 10-3, the reduced drag can be expected to exceed one minute for larger diameters projectiles 10, 10-1, 10-2, 10-3, such as a cannon round.

In some embodiments, the projectiles 10, 10-1, 10-2, 10-3 may be packaged with a sabot that protects the leading end element 32 prior to discharge but which separates from the projectile 10-2 at some point post-discharge, thereby exposing the leading end element 32 to the atmosphere during flight. In such embodiments, the conductive bullet core 30 need not be moved with respect to the conductive shell 22.

Those skilled in the art will recognize improvements and modifications to the preferred embodiments of the disclosure. All such improvements and modifications are considered within the scope of the concepts disclosed herein and the claims that follow.

What is claimed is:

1. A projectile comprising:

a conductive shell having a leading end and a trailing end, the conductive shell forming an interior volume;

a conductive bullet core disposed at least partially within the interior volume and having a leading end element, the conductive bullet core electrically insulated from the conductive shell;

a voltage system coupled to the conductive bullet core; and wherein the projectile is configured to expose the leading end element to an atmosphere during flight and the voltage system is configured to, during flight, generate a voltage at the leading end element that forms a corona discharge at the leading end element.

2. The projectile of claim 1, wherein the leading end of the conductive shell forms an opening sized to allow at least a portion of the leading end element to extend beyond the opening.

3. The projectile of claim 2, wherein the projectile has a pre-discharge orientation and a post-discharge orientation that is different from the pre-discharge orientation, and further comprising a non-conductive cap coupled to the leading end of the conductive shell, the non-conductive cap configured to prevent the leading end element from extending beyond the non-conductive cap in the pre-discharge orientation.

4. The projectile of claim 1, wherein the voltage system comprises:

a piezoelectric element; and a resistor coupled between the piezoelectric element and the conductive bullet core.

5. The projectile of claim 4, further comprising an insulator positioned between the piezoelectric element and the conductive bullet core.

6. The projectile of claim 5, wherein the insulator comprises a sapphire insulator, is annular, and forms an opening at a center of the sapphire insulator, and wherein the resistor is disposed in the opening.

7. The projectile of claim 4, wherein the trailing end of the conductive shell forms an opening between the interior volume and an environment exterior to the trailing end of the conductive shell, the opening configured to allow pressure generated in the environment to enter the interior volume.

8. The projectile of claim 7, wherein the opening comprises a predetermined size to allow a predetermined pressure generated in the environment to enter the interior volume.

9. The projectile of claim 4, further comprising:

a crush piston positioned within the interior volume between the opening and the piezoelectric element, the crush piston configured to move the piezoelectric element with respect to the conductive shell in a direction toward the leading end of the conductive shell.

10. The projectile of claim 9, further comprising an insulative collar that completely surrounds at least a portion of an outer perimeter of the piezoelectric element and prevents direct electrical contact between the piezoelectric element and the conductive shell.

11. The projectile of claim 10, further comprising an annular metal guide positioned between the piezoelectric element and the crush piston, the annular metal guide in electrical contact with the voltage system and the conductive shell.

12. The projectile of claim 11, wherein the annular metal guide comprises an annular edge in contact with the insulative collar, the annular metal guide configured to urge the insulative collar in the direction toward the leading end of the conductive shell.

13. The projectile of claim 1, wherein the projectile has a pre-discharge orientation and a post-discharge orientation that is different from the pre-discharge orientation, and the conductive shell has an interior surface configured to halt forward progress of the conductive bullet core with respect to the conductive shell as the conductive bullet core is moved from the pre-discharge orientation to the post-discharge orientation.

14. The projectile of claim 13, further comprising a bearing travel stop configured to engage the interior surface of the conductive shell and the conductive bullet core to halt the forward progress of the conductive bullet core with respect to the conductive shell as the conductive bullet core is moved from the pre-discharge orientation to the post-discharge orientation.

15. The projectile of claim 14, wherein the bearing travel stop comprises sapphire.

16. The projectile of claim 1, wherein:

the conductive shell comprises an interior surface and further comprises a polymide film coating disposed on the interior surface;

the conductive bullet core comprises an exterior surface and further comprises a polymide film coating disposed on the exterior surface;

the projectile has a pre-discharge orientation and a post-discharge orientation that is different from the pre-discharge orientation; and in the post-discharge position, the polymide film coating disposed on the exterior surface of the conductive bullet core is bonded with the polymide film coating disposed on the interior surface of the conductive shell, such that the conductive bullet core is fixed with respect to the conductive shell.

17. The projectile of claim 1, further comprising:

a case forming an opening and an interior volume;

a propellant disposed in the interior volume; and wherein the trailing end of the conductive shell is positioned within the opening and extends into the interior volume, and wherein the case is configured to grip the trailing end of the conductive shell.

18. The projectile of claim 1, wherein the voltage system comprises:

a piezoelectric element;

a diode comprising a first diode terminal and a second diode terminal, the first diode terminal electrically coupled to the piezoelectric element;

a capacitor comprising a first capacitor terminal and a second capacitor terminal, the first capacitor terminal electrically coupled to the second diode terminal;

a resistor comprising a first resistor terminal and a second resistor terminal, the first resistor terminal coupled to the second diode terminal and the second resistor terminal coupled to the conductive metal core.

19. The projectile of claim 1, wherein the leading end element has a radius of less than about 50 microns.

20. The projectile of claim 1, wherein the conductive shell is symmetrical about a longitudinal axis, and has a greatest radius in a plane perpendicular to the longitudinal axis of 7.62 millimeters (mm).

21. The projectile of claim 1, wherein the voltage system has a first terminal electrically coupled to the conductive shell and a second terminal electrically coupled to the conductive bullet core.

22. The projectile of claim 1, wherein the trailing end of the conductive shell forms an opening between the interior volume and an environment exterior to the trailing end of the conductive shell, the opening configured to receive a launch plug associated with a launching mechanism.

23. The projectile of claim 1, wherein the voltage system comprises a capacitor configured to be electrically coupled to a coil end of a coil during a discharge of the projectile to receive an electric charge during the discharge of the projectile.

24. A projectile comprising:

a conductive shell forming an interior volume;

a conductive bullet core disposed at least partially within the interior volume and having a leading end element, the conductive bullet core electrically insulated from the conductive shell; and a voltage system disposed within the interior volume having a first terminal electrically coupled to the conductive shell and a second terminal electrically coupled to the conductive bullet core, the voltage system configured to provide a voltage at the leading end element during flight of the projectile to form a corona discharge at the leading end element.

* * * * *